United States Patent [19]

Piegza

[11] 4,255,079

[45] Mar. 10, 1981

[54] SELF-PRIMING SYSTEM FOR PUMPS

[75] Inventor: Tad Piegza, Bayonne, N.J.

[73] Assignee: Penco Division of Hudson Engineering Company, Hoboken, N.J.

[21] Appl. No.: 63,696

[22] Filed: Aug. 6, 1979

[51] Int. Cl.[3] ..... F01B 25/00

[52] U.S. Cl. ..... 415/11

[58] Field of Search ..... 417/199, 278; 415/11

[56] References Cited

U.S. PATENT DOCUMENTS

| | | | |
|---|---|---|---|
| 1,206,385 | 11/1916 | Sperry | 415/11 |
| 3,370,604 | 2/1968 | Napolitano | 137/117 |
| 3,381,618 | 5/1968 | Napolitano | 415/11 |
| 3,425,436 | 2/1969 | Napolitano | 415/11 |
| 3,434,430 | 3/1969 | Bermann et al. | 415/11 |
| 3,741,675 | 6/1973 | Porter | 415/11 |

FOREIGN PATENT DOCUMENTS

| | | | |
|---|---|---|---|
| 893086 | 4/1962 | United Kingdom | 415/11 |

*Primary Examiner*—William L. Freeh

*Attorney, Agent, or Firm*—Fleit & Jacobson

[57] ABSTRACT

A self-priming pump system having a repriming valve opened in response to variations in fluid movement through a reservoir that includes a flow restriction. A control system is provided that includes a first sensor for sensing pressure within the flow restriction, a second sensor for sensing pressure within a portion of the reservoir spaced from the flow restriction, and a control mechanism for comparing the sensed signals and for opening the repriming valve when the difference between the signals falls to or below a predetermined value.

3 Claims, 1 Drawing Figure

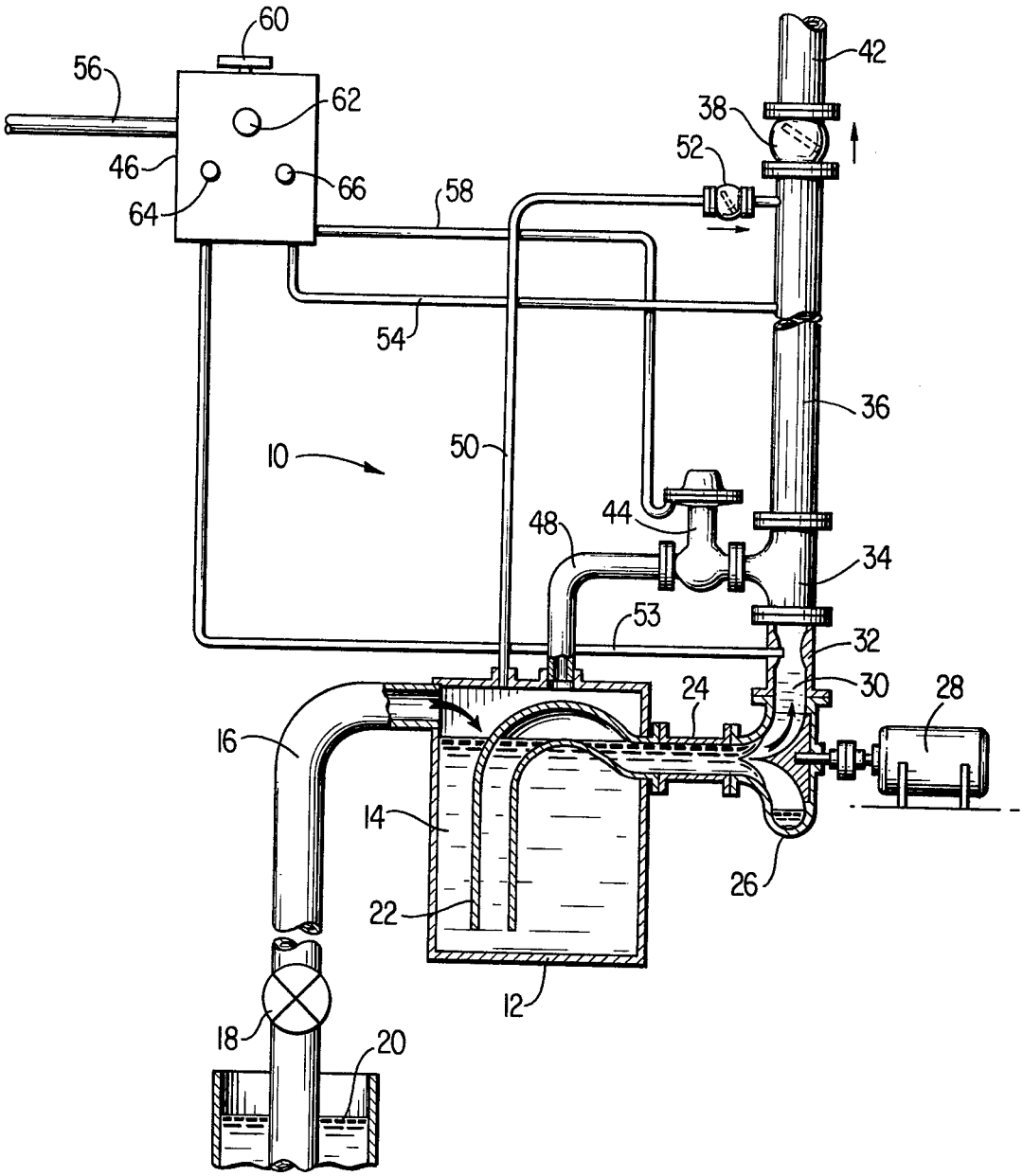
60
56
62
46
66
64
58
42
38
52
54
36
10
50
44
48
34
53
32
30
24
28
16
14
26
22
12
18
20

SELF-PRIMING SYSTEM FOR PUMPS

BACKGROUND OF THE INVENTION

1. Field of the Invention

The present invention relates to a self-priming pumping system. More particularly, the present invention relates to self-priming pumping systems of the type described in U.S. Pat. Nos. 3,370,604 and 3,381,618, the contents of which are incorporated herein by reference.

2. Description of the Prior Art

In the past, there have been many different devices developed to automatically prime a liquid pump when the pump runs dry due to an insufficient amount of liquid being present at the pump inlet and to prevent air from being introduced to the suction side of the pump. These devices are essential to the efficient operation of a pumping system, since, as is well known, once air is admitted to the suction passage in sufficient quantities to allow the pump to exhaust the supply of liquid in the suction well, the pump no longer is able to maintain suction to pump the liquid. Consequently, the pumping operation must be stopped and the attention of an operator is required, if no automatic mechanism for repriming the system is provided.

Previously known automatic mechanisms, such as those described in the aforementioned U.S. patents and U.S. Pat. No. 3,434,430, generally provide satisfactory performance; however, problems are sometimes encountered when pumping high viscosity liquids over prolonged periods of time. During such pumping operations, vapor pressures can build up within the system and cause unnecessary actuations of the self-priming system. Also, difficulty has been experienced with previously known self-priming systems when the systems are used to pump liquids having different viscosities and/or vapor pressures.

SUMMARY OF THE INVENTION

In accordance with the present invention, a pump is primed by liquid from a suction well or reservoir located at the pump inlet. The suction well is normally supplied with liquid to be pumped by a suction line communicating with the liquid source of pumpage. A power-operated repriming valve is located in the pump discharge column to allow automatic recycling of liquid from the discharge line to the suction well when the pump has lost suction. A one-way check valve is positioned downstream from the repriming valve and allows fluid movement only in the downstream direction, and thus limits the quantity of liquid which may be recycled to that in the system between the priming valve and the check valve. An air relief line with a one-way check valve connects the top of the suction well to the discharge column intermediate the first mentioned check valve and the repriming valve. Air is displaced from the suction well through the air relief line by the liquid which is recycled from the discharge column through the repriming valve to the suction well. When a portion of the recycled liquid flows from the suction well into the pump inlet, the liquid will be pumped into the discharge column causing the repriming valve to close. If the pump is not fully reprimed, the repriming valve will thereafter again allow the same liquid to be recycled to the suction well. This recycling will continue in this fashion until the normal pumping cycle is restored.

The present invention is designed for automatically repriming single or multi-stage pumps employing any reasonable length suction line. In the event of loss of suction head due to the pump running dry, there is no danger of pump damage since the system will continue to reprime itself.

According to a feature of the present invention, an air relief line vents air from the impeller inlet casing. It has been found that when liquid in the suction well is exhausted and air is sucked into the pump, an air lock may be formed between the inlet of the pump intake line and the impeller. This entrapped air may keep liquid from reaching that point in the impeller section of the pump where sufficient velocity can be imparted to it to force the liquid and the entrapped air into the discharge column. By the use of an air relief line extending through the casing of the pump impeller chamber, a path is provided for venting such entrapped air when the repriming fluid flows into the pump inlet. According to a still further feature of the present invention, the controlled automatic recycling of liquid from the discharge side of a pump to its suction side is provided by a controllable power actuated valve that responds to the loss of suction of the pump, as evidenced by a reduced flow level. The amount of pressure variation required to actuate the valve is selectively variable so that the system responds to the characteristics of the fluid being pumped.

The present invention also provides a self-priming system having a power-operated priming mechanism so that positive priming action can be achieved under power after either long periods of inactivity, when system mechanisms are likely to be fouled, or when system mechanisms are likely to become fouled do to the characteristics of the liquid being pumped.

Still another feature of the present invention is the provision of a system that prevents a pump from running without lubrication due to loss of suction fluid, which can be caused by the closing of valves on tanks from which the pump is taking liquid, or from pumping the liquid level in the tank to a point below that which can be accommodated by the pump being used.

Yet another feature of the present invention is the provision of a self-priming pumping system using a tunable power-operated priming mechanism that allows a system designer or operator to determine the point at which the positive priming action takes place. This feature enables the system to accommodate required changes and to accommodate a wide range of pumped fluids.

The invention, and its objects and advantages, will become more apparent in the detailed description of a preferred embodiment presented below.

BRIEF DESCRIPTION OF THE DRAWING

In the detailed description of the preferred embodiment of the invention presented below, reference is made to the accompanying drawing. The drawing is a side elevational view, partially in section, illustrating one embodiment of the present invention.

DESCRIPTION OF THE PREFERRED EMBODIMENT

Because self-priming systems for pumps are well known, the present description will be directed in particular to elements forming part of, or cooperating more directly with, the present invention. Elements not specifically shown or described herein are understood to be selectable from those known in the art.

Referring now to the drawing, a self-priming system, which is generally designated 10, is illustrated. The system 10 is intended for use with a pumping system having a suction well or casing 12 which acts as a reservoir for priming liquid 14. In normal operation, liquid 14 is supplied to the suction well through a suction line 16 having a tank suction valve 18 positioned therein. One end of line 16 is connected to well 4, while the other end is connected to pumpage 20. A suction skirt 22 is positioned with its lower end adjacent the bottom of suction well 12 and is connected at its other end to an inlet 24 of a pump 26. The pump 26, which may be either a horizontal or vertical pump, is driven by a motor 28 or other suitable mechanism. In the illustated embodiment, suction skirt 22 has a curved upper portion, the lower inner surface of which is approximately level with the upper inner surface of the eye of the impeller, i.e., the horizontal inlet 24. A small aperture may be provided in the curved upper portion of the skirt 22 to function as an air bleed between this portion of the skirt and the top of the suction well 12. It is also possible to connect the vertically extending portion of skirt 22 to the pump inlet without elevating the upper portion of the skirt above the pump inlet 24, for example, by means of a 90° pipe elbow.

Pump 26 pumps fluid through an inlet 30 and a venturi 32, to be described hereinafter, into a tee fitting 34 and a discharge column 36. A one-way check valve 38 is positioned at the upper end of the discharge column 36 and connects the discharge column to a discharge line 42. A commercially available power-operated valve, commonly referred to as a repriming valve or priming valve 44, having a power controller 46, leads from the tee fitting 34 through a drain line 48 to the top of the suction well 12, so that liquid may be recycled in a manner to be described hereinafter to reprime the pump 26. The liquid in discharge column 36 and the quantity of liquid in tee fitting 34 above the level of drain pipe 48 are available to reprime the pump. Therefore, the discharge column 36 and the above-mentioned portion of tee fitting 34 effectively function as a reservoir for repriming liquid. The volumetric capacity of this reservoir is at least sufficient to ensure that the quantity of liquid available to reprime the pump is sufficient to fill the pump inlet, inlet skirt 24, skirt 22, and suction well 12 to a level corresponding to the level of the eye of the pump impeller. An air relief conduit 50 leads from the top of the enclosed suction well 12 to the upper end of the discharge column 36 upstream from the check valve 38. A one-way check valve 52 in conduit 50 allows fluid movement only in a direction towards discharge column 36 to prevent liquid in column 36 from returning to the suction well via conduit 50.

A pressure sensing tube 53 is connected from an opening in the throat of the venturi 32 to the power controller 46. A second pressure sensing tube 54 is connected from an opening in the discharge column 36 to the power controller 46. The power controller 46 is supplied with air via line 56. Alternatively, power controller 46 can be operated by another power fluid, such as hydraulic oil, or can be operated electrically such that the operating medium in line 58 controls the position of the priming valve 44. The controller 46 is a commercially available unit and is externally adjustable through an adjusting mechanism 60 in accordance with the readings on a valve actuating pressure gauge 62 and the gauges 64 and 66, which read the sensed venturi pressure and the sensed discharge column pressure, respectively.

The operation of the self-priming system illustrated in the drawing will now be described.

When the system 10 is idle and no liquid is being pumped, the priming valve 44 is in the closed position and is held closed by a spring or other suitable mechanism.

When liquid is being pumped during normal operation, the priming valve 44 is also in the closed position in that the power controller 46 senses the differential pressure between line 53 and line 54, due to the velocity head of the liquid being moved through the venturi 32, and operates to maintain the valve in closed position.

When the velocity of the liquid flowing through the system is reduced or is stopped by, for example, the introduction of air or other gases to the pump suction when, for example, the pumpage 20 is at a reduced level, or by the closure of tank suction valve 18, the pressure differential between the sensing lines 54 and 53 is reduced inasmuch as the velocity head of the fluid being pumped is reduced. In this case, the power controller 46 acts to open the priming valve 44, thereby dumping or discharging the liquid in discharge column 36 through tee 34, valve 44, and line 48 to the suction well 12. This dumping or discharging ensures that pump 26 has a sufficient supply of fluid at its suction inlet 22.

The point at which priming valve 44 opens in response to a change in pressure differential is influenced by many factors, such as the viscosity of the fluid being pumped and the vapor pressure of the fluid. Therefore, in order to enable the system operator to suitably adjust the response point, priming valve controller 46 is provided with an adjusting knob 60 to vary the amount of valve actuating pressure in line 58 in proportion to and in response to a predetermined pressure differential sensed in lines 53 and 54.

As repriming liquid enters into suction well 12, air is displaced through air relief conduit 50 and check valve 52 into the now empty upper end of discharge column 36. When the repriming flue from the suction well passes through the suction skirt 22 into the pump inlet 24, the pump 26 then draws the repriming liquid out of the suction well and pumps it into the discharge column 36. The flow of the repriming liquid from the pump outlet reestablishes the pressure differential which causes the power controller 46 to move the repriming valve 44 into a closed position. Check valve 52 closes as the liquid enters the discharge column 36, and the air which has entered the discharge column is now forced through check valve 38 into discharge line 42. The removal of liquid from the suction well 12 reduces the pressure at the opening of suction line 16, so that liquid is drawn upward therein. When the repriming liquid is depleted, the cycle is repeated as many times as necessary until suction is reestablished for the pump 26. Factors such as the length and diameter of the suction line 16 determine how many times the pump will be reprimed before full pumpage flow is reestablished.

As an aide to understanding the present invention, some components usable with the present invention will now be identified. A suitable repriming valve 44 is manufactured by the Norris Division of The Dover Corporation. The valve uses a NORRISEAL diaphragm actuator to control a NORRISEAL butterfly valve. Suitable pressure sensing elements associated with lines 53 and 54 include the model 40 series pneumatic indicating controllers and transmitters for pressure manufactured by the Ametek Controls Division. A suitable power controller 46 is the electronic indicating differential pressure transmitter, model 70, also manufactured by the Ametek Controls Division of Feasterville, Pennsylvania.

While a preferred embodiment of the present invention has been illustrated and described, it will be understood that various changes and modifications may be made without departing from the scope and spirit of the present invention. Accordingly, the present invention is intended to encompass all changes and modifications that fall within the scope and spirit of the appended claims.

What is claimed is:

1. In a self-priming pump system comprising a pump having an outlet and an inlet, a suction well defining a cavity at least partially below said inlet, suction line means for introducing liquid to be pumped into said cavity to a level including the top of the inlet, conduit means positioned in said cavity with one end terminating below said inlet adjacent the bottom of said cavity and with its other end connected to said inlet, reservoir means having an upstream end and a downstream end, said upstream end of said reservoir means connected to said outlet of said pump, a one-way check valve located at said downstream end of said reservoir means enabling downstream fluid movement only, drain means interconnecting said cavity and said reservoir means, repriming valve means positioned upstream from said check valve and mutually cooperating with said reservoir means and said drain means to return liquid in said reservoir means to said cavity via said drain means in response to a reduction in liquid flow from said pump, an air relief pipe connected from the top of said cavity to said reservoir means adjacent the upstream side of said check valve, and a second one-way check valve provided in said air relief pipe enabling fluid movement only in a direction towards said reservoir means, the improvement wherein the drain means includes a tee-connection positioned in a lower portion of the reservoir means and pipe means for interconnecting said tee-connection and the cavity, the repriming valve means being positioned in said pipe means; wherein the reservoir means includes venturi means for defining a flow restriction therein; and wherein the system includes adjustable control means for selectively actuating the repriming valve means in response to variations in fluid movement through the reservoir means, said control means including:

first means for sensing and generating a first signal representative of the pressure within said flow restriction;

second means for sensing and generating a second signal representative of the pressure within the reservoir means at a position spaced from said flow restriction; and controller means for comparing said first and said second signals and for opening the repriming valve when the difference between the signals falls to a predetermined point, the predetermined point being adjustable so that the system responds to the characteristics liquid being pumped.

2. The improvement of claim 1, wherein said adjustable control means includes manually operable means for selectively opening the repriming valve.

3. A self-priming horizontal pump system comprisinga pump having an outlet and a horizontal inlet, a suction well defining a cavity at least partially below said inlet, suction line means for introducing liquid to be pumped into said cavity to a level including the top of the inlet, conduit means positioned in said cavity with one end terminating below said inlet adjacent the bottom of said cavity and with its other end connected to said inlet, reservoir means having an upstream end and a downstream end, said upstream end of said reservoir means connected to said outlet of said pump, a one-way check valve located at said downstream end of said reservoir means enabling downstream fluid movement only, drain means interconnecting said cavity and said reservoir means, repriming valve means positioned upstream from said check valve and mutually cooperating with said reservoir means and said drain means to return liquid in said reservoir means to said cavity via said drain means in response to a reduction in liquid flow from said pump, an air relief pipe connected from the top of said cavity to said reservoir means adjacent the upstream side of said check valve, and a second one-way check valve provided in said air relief pipe enabling fluid movement only in a direction towards said reservoir means, the improvement wherein the drain means includes a tee-connection positioned in a lower portion of the reservoir means and pipe means for interconnecting said tee-connection and the cavity, the repriming valve means being positioned in said pipe means; wherein the reservoir means includes venturi means for defining a flow restriction therein; and wherein the system includes adjustable control means for selectively actuating the repriming valve means in response to variations in fluid movement through the reservoir means, said control means including:

first means for sensing and generating a first signal representative of the pressure within said flow restriction;

second means for sensing and generating a second signal representative of the pressure within the reservoir means at a position spaced from said flow restriction; and controller means for comparing said first and said second signals and for opening the repriming valve when the difference between the signals falls to an adjustble predetermined point.

* * * * *